US005768805A

United States Patent [19]

Saviane

[11] Patent Number: 5,768,805

[45] Date of Patent: Jun. 23, 1998

[54] SKI BOOT

[76] Inventor: Luigi Saviane, Feltrina 33 Sud, 31044 Montebelluna (TV), Italy

[21] Appl. No.: 863,450

[22] Filed: May 27, 1997

Related U.S. Application Data

[63] Continuation of Ser. No. 705,015, Aug. 29, 1996, abandoned, which is a continuation of Ser. No. 435,187, May 5, 1995, abandoned.

[30] Foreign Application Priority Data

May 24, 1994 [CH] Switzerland ..... 1604/94

[51] Int. Cl.[6] ..... A43B 5/04

[52] U.S. Cl. ..... 36/50.5

[58] Field of Search ..... 36/117–119.1, 36/50.5, 54; 24/68 SK, 69 SK, 71 SK

[56] References Cited

U.S. PATENT DOCUMENTS 5,031,340 7/1991 Hilgarth ..... 36/117
5,228,219 7/1993 Tonel ..... 36/117
5,279,052 1/1994 Perotto et al. ..... 36/117

FOREIGN PATENT DOCUMENTS 0517219 12/1992 European Pat. Off. .
0572775 12/1993 European Pat. Off. .
0583565 2/1994 European Pat. Off. .
8336239 2/1984 Germany .

*Primary Examiner*—Ted Kavanaugh
*Attorney, Agent, or Firm*—Kane, Dalsimer, Sullivan, Kurucz, Levy, Eisele and Richard, LLP

[57] ABSTRACT

Ski boot comprising a shell (1) made of plastic material which closes over the front of the foot by virtue of two superposed flaps (2, 3). The slot formed at the front end of the flaps is covered by a part of the boot which is involved in the closing and the tightening of the shell. This part is either a tab which prolongs the end of the upper flap (3), or a lateral extension, toward the front, of a closing and tightening strap.

6 Claims, 2 Drawing Sheets

FIG. 1
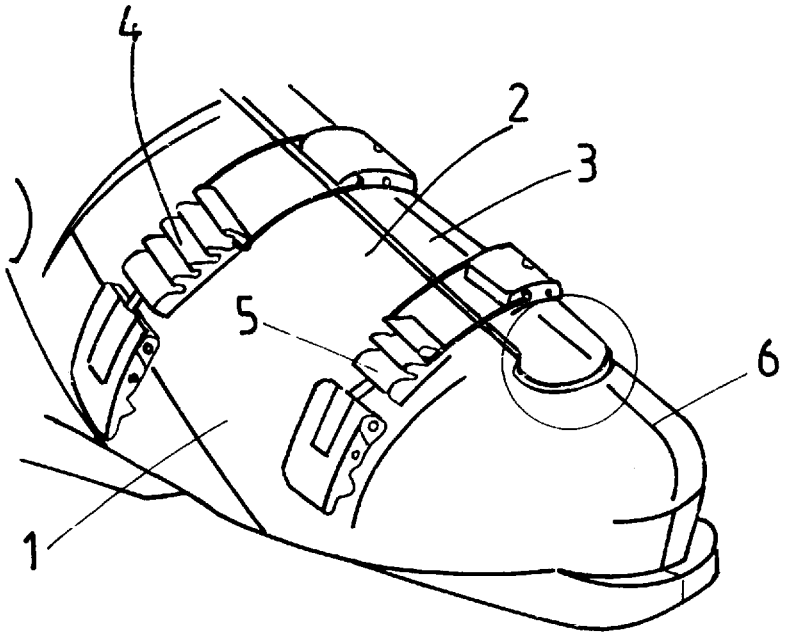
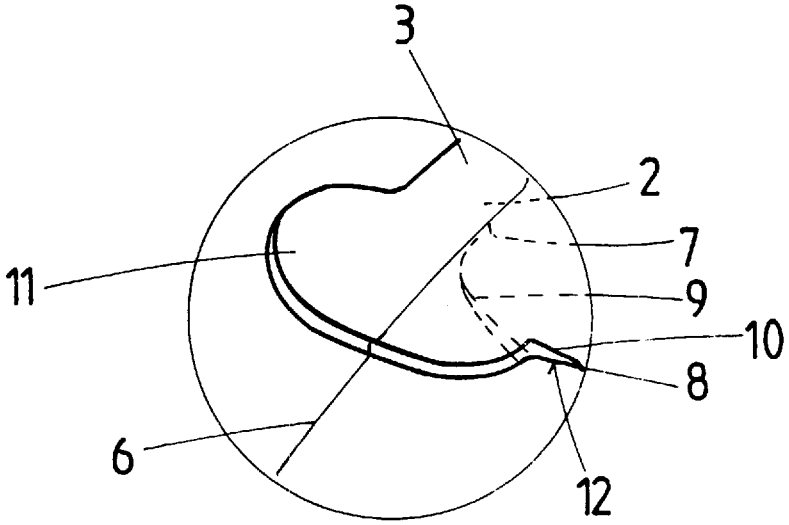
FIG. 2

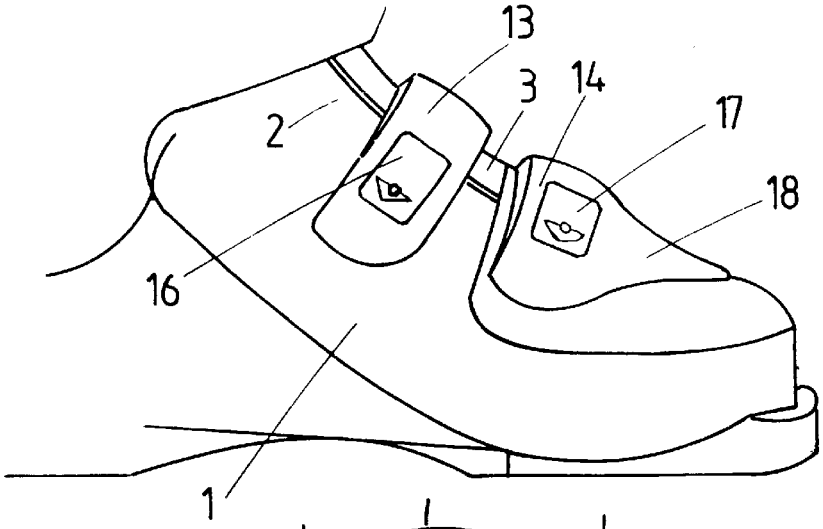
FIG. 3
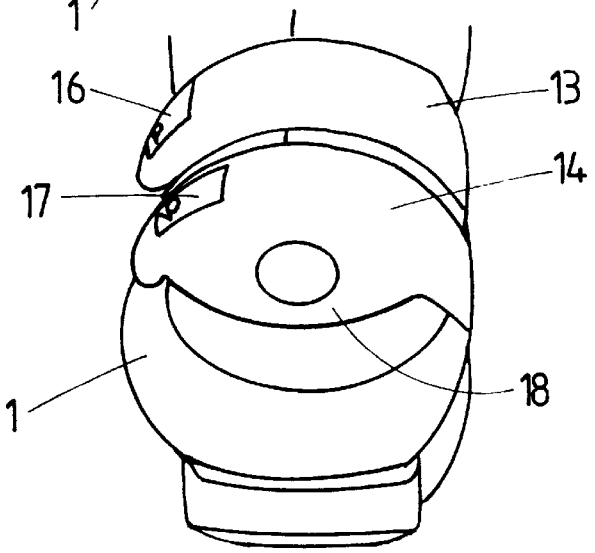
FIG. 4
FIG. 5
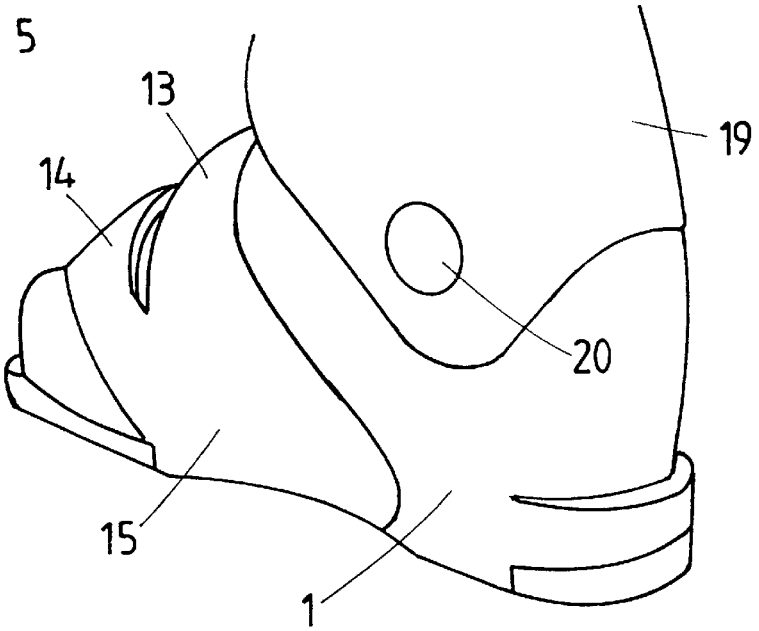

SKI BOOT

FIELD OF THE INVENTION

This application is a continuation of application number 08/705,015, now abandoned, filed Aug. 29,1996, which was a continuation of application number 08/435,187 filed May 5, 1995, now abandoned.

The present invention relates to a ski boot comprising a variable-volume shell made of plastic material which closes over the front of the foot and of the instep by virtue of two superposed flaps, means of closing and of tightening these flaps and at least one part covering at least the front end, that is to say the end close to the tip of the foot, of the lower flap.

Shells of variable-volume boots have, at the front end of the flaps, a transverse slot formed between the transverse edge of the cut of the shell and the end of the flaps. In order to prevent snow and water penetrating the boot via this slot, it is usual to seal this slot by means of a relatively soft piece made of rubber. This piece made of rubber must always be well tightened when the boot is closed. If the piece made of rubber is relatively thick, this aim is achieved, but the installation of the piece made of rubber is inconvenient. A thin piece made of rubber is easier to instal, but it does not always provide the desired impermeability. Moreover, this piece made of rubber can be displaced during the total opening of the flaps, so that it no longer provides the desired impermeability.

PRIOR ART

Boots are known in which the upper flap has been prolonged towards the front (CABER, Collection 86/87) but only half the slot is covered thus.

In Japanese utility model 4—45 522, it has been proposed to provide the impermeability of this part of the shell by means of an additional covering piece fixed on the front end of the shell.

In document EP-583 565, a solution is moreover described which consists in replacing the usual piece made of rubber with a plate made of elastic material which extends under the two flaps and is fixed by a wing to the upper flap.

SUMMARY OF THE INVENTION

The aim of the present invention is to improve the impermeability of the shell at the end of the flaps without resorting to a special additional piece.

In the boot according to the invention, the part covering at least the front end of the lower flap is a part of the boot which is involved in the closing and the tightening of the shell.

This part is constituted by a tab which prolongs the end of the upper flap or by a lateral extension of a closing and tightening strap which in this case also covers the end of the upper flap.

In boots equipped with a closing and tightening strap, both solutions can be used simultaneously in such a manner that the impermeability is thereby further improved.

BRIEF DESCRIPTION OF THE DRAWINGS

The attached drawing represents, by way of example, two embodiments of the invention.

FIG. 1 is a partial view of a ski boot showing a first embodiment of the invention.

FIG. 2 is a view of a detil of FIG. 1.

FIG. 3 is a partial side view of a boot according to a second embodiment.

FIG. 4 is partial front view of this same boot.

FIG. 5 is a partial perspective view of this same boot seen from the rear and from the inner side of the foot.

DESCRIPTION OF THE PREFERRED EMBODIMENT(S)

In FIG. 1, the front part of a shell 1 of a ski boot can be seen. This shell 1 is of the variable-volume type, that is to say that it closes over the foot and over the instep by virtue of two flaps 2 and 3, the flap 2 being the lower flap and the flap 3 the upper flap. The flaps are held in position one on the other and the shell is tightened by means of two buckles 4 and 5. In their upper part (not shown), the flaps 2 and 3 are covered by the collar of the boot.

In contrast with conventional boots, the end of the lower flap 2 close to the tip of the foot is not formed by a transverse slot on the median line 6 of the shell, but the longitudinal edge 7 of the lower flap 2, which here coincides with the median line 6, is connected to the root 8 of the upper flap 3 by a cut 9 of rounded shape tangential to the edge 7 and to the front edge 10 of the upper flap 3. Moreover, the end of the upper flap 3 is prolonged by a tab 11 which covers the end of the lower flap 2, in particular the cut 9. The tab 11 has the shape of a blade and also extends laterally beyond the longitudinal edge of the upper flap 3. Only a short rectilinear incised part 12 of the shell, which makes possible good opening of the upper flap 3, is not covered. This part is, however, very short and the incision is closed sufficiently in the closed position of the shell.

It will be noted that in the case where the lower flap 2 had a front edge extending from the other side of the median line 6, the tab 11 would also cover the end of the lower flap.

In the second embodiment represented in FIGS. 3 to 5, the shell 1 is equipped, instead and in place of the buckles 4 and 5, with two straps 13 and 14 made of semi-rigid plastic material originating from a common band 15 fixed to the sole on the inner side of the foot. These straps are each equipped with a buckle, the levers 16 and 17 respectively of which can be distinguished mounted in a cutout of the straps, these buckles making it possible to attach and tighten the straps on the outer side of the shell 1. These buckles are of the type described in the pat. CH 504 850. The lower strap 14 is equipped with a lateral extension 18 which extends in the direction of the toe of the boot, following the shape of the shell and covering the ends of the flaps 2 and 3. The end of the flaps can be made in a conventional manner or according to the first embodiment.

In FIG. 5, a part of the collar 19 articulated at 20 on the shell 1 can be distinguished.

I claim:

1. A ski boot having a front, a rear, and comprising:

a variable volume shell (1) made of plastic material, said shell closing over a front and an instep of a wearer's foot by virtue of two superposed flaps (2, 3), said two superposed flaps comprising a one-piece upper flap (3) and a lower flap (2), both said flaps having a front end being close to the front of the boot and a longitudinal edge, means for closing and for tightening (4, 5, 13, 14, 16, 17) said shell, and means for improving the impermeability of the shell comprising at least one portion of said upper flap covering at least said front end of said lower flap (2), said portion being an element of said ski boot which is involved in the closing and the tightening of said shell;

wherein said portion is an integral tab-shaped extension (11) of said front end of said upper flap, said extension covering said front end of the lower flap.

2. The ski boot as claimed in claim 1 wherein a band (15) is fixed to the sole on the inner side of the shell, said means for closing and tightening said shell extending from the band.

3. The ski boot as claimed in claim 2 wherein the means for closing and tightening having a lateral extension covering the end of the upper flap.

4. The ski boot as claimed in claim 1, wherein said tab (11) has the shape of a rounded pallet.

5. A ski boot having a front, a rear, and comprising:

a variable volume shell (1) made of plastic material said shell closing over a front and an instep of a wearer's foot by virtue of two superposed flaps (2 3) said two superposed flaps comprising an upper flap (3) and a lower flap (2), both said flaps having a front end being close to the front of the boot and a longitudinal edge means for closing and for tightening (4, 5, 13, 14, 16, 17) said shell and means for improving the impermeability of the shell comprising at least one part covering at least said front end of said lower flap (2), said part being an element of said ski boot which is involved in the closing and the tightening of said shell, wherein said part is an integral tab-shaped extension (11) of said front end of said upper flap. said extension covering said front end of the lower flap, and wherein said upper flap (3) is linked to said shell (1) by a root (8) and wherein at the front end of said boot, the longitudinal edge (7) of said lower flap (2) is connected to said root and followed at its connection to said root of said upper flap (3) by a cut (9) of the shell, the upper flap (3) having a front end (10), the cut being tangential to the edge (7) of said lower flap and to the front end (10) of the upper flap.

6. The ski boot as claimed in claim 5, wherein said edge of said out (9) is connected to said longitudinal edge (7) of said lower flap (2) by a curve tangential to said longitudinal edge of said lower flap.

* * * * *

UNITED STATES PATENT AND TRADEMARK OFFICE

CERTIFICATE OF CORRECTION

PATENT NO. : 5,768,805

DATED : Jun. 23, 1998

INVENTOR(S) : Saviane

It is certified that error appears in the above-identified patent and that said Letters Patent is hereby corrected as shown below:

Title page insert: --[73] Assignee: LANGE INTERNATIONAL S.A., Switzerland--

Signed and Sealed this

Third Day of August, 1999

*Attest:*

*Attesting Officer*

Q. TODD DICKINSON

*Acting Commissioner of Patents and Trademarks*